US005868162A

United States Patent [19]

Dickerson, Jr.

[11] Patent Number: 5,868,162

[45] Date of Patent: Feb. 9, 1999

[54] AUTOMATICALLY SWITCHING VALVE WITH REMOTE SIGNALING

[76] Inventor: William H. Dickerson, Jr., 2502 Technology Dr., Hayward, Calif. 94545

[21] Appl. No.: 810,575

[22] Filed: Mar. 3, 1997

[51] Int. Cl.[6] ..... E03B 7/07

[52] U.S. Cl. ..... 137/557; 137/113; 137/487.5; 251/129.04

[58] Field of Search ..... 137/113, 557, 137/487.5, 551; 251/129.04

[56] References Cited

U.S. PATENT DOCUMENTS

| | | | |
|---|---|---|---|
| 3,852,740 | 12/1974 | Haymes . | |
| 3,909,841 | 9/1975 | Holler et al. . | |
| 4,091,840 | 5/1978 | Grove et al. | 137/269 |
| 4,247,018 | 1/1981 | Credlie | 137/113 |
| 4,465,094 | 8/1984 | Huffhines et al. | 137/557 |
| 4,633,235 | 12/1986 | DeGennaro . | |
| 5,025,248 | 6/1991 | Bergeron . | |
| 5,062,443 | 11/1991 | Maric | 137/113 |
| 5,441,076 | 8/1995 | Moriya et al. | 137/486 |
| 5,554,976 | 9/1996 | Miyauchi et al. | 137/557 |

*Primary Examiner*—Denise L. Ferensic
*Assistant Examiner*—John Ball
*Attorney, Agent, or Firm*—James D. Ivey

[57] ABSTRACT

An automatically switching valve measures pressure at an outlet line using an electric, pressure-sensitive switch which can be set to close at a predetermined pressure threshold within relatively narrow tolerances such that a pressure regulator can be placed between the pressurized gas supply tanks and the switching valve. Closing of the pressure-sensitive switch in response to the drop in pressure below the predetermined threshold sends an electric signal to a relay. In response to the electric signal, the relay causes a different inlet line to be selected, thus changing the particular pressurized gas supply from which the outlet line receives pressurized gas. When gas is supplied through a first inlet line, an electric signal from the pressure-sensitive switch causes the relay to toggle to supply gas through a second inlet line. A subsequent signal from the pressure-sensitive switch causes the relay to toggle back to again supply gas through the first inlet line. No manual resetting of the switching valve according to the present invention is required. The electric signal of the pressure-sensitive switch also triggers a remote signaling device to signal a remote location. For example, the electric signal can trigger dialing of a predetermined telephone number by an automatic dialer. When connected to the remote location, the dialer can transmit a predetermined message which uniquely identifies a particular pressurized gas dispensing installation as the installation in which an empty pressurized-gas supply is detected.

6 Claims, 2 Drawing Sheets

TELEPHONE LINE 128
100

118
RJ11
+
-
3
2
6 J
RELAY
H 1
7 T
N 8
116
AUTOMATIC DIALER
122
POWER TRANSFORMER
N
H
114
126
S
H
IMPULSE RELAY
N
T
112
FUSE
124
H
N
3-WAY SOLENOID 102
A
B
OUT
T
H
PRESSURE SWITCH
108
110
SWITCH
106
104A
104B
120N
120H
FROM SUPPLY 202A
FROM SUPPLY 202B
OUT TO EQUIPMENT 208
N
H
120V A/C

AUTOMATICALLY SWITCHING VALVE WITH REMOTE SIGNALING

FIELD OF THE INVENTION

The present invention relates to pressurized gas valves and, in particular, to a valve which switches from one pressurized gas supply to another upon automatic detection of a reduction in pressure in the former pressurized gas supply.

BACKGROUND OF THE INVENTION

Pressurized gas is used in a number of applications ranging from carbonated beverage dispensers to oxygen systems used in medical and high-altitude environments. Pressurized gas is typically provided in pressurized tanks which release gas at a predetermined pressure through a regulator. When most of the gas has been dispensed from a particular tank, the gas pressure drops to a level below that which is necessary for the intended application. In the case of carbonated beverage dispensers, the beverages cease to be carbonated, i.e., becomes "flat". The tank is then typically replaced with a new, full tank of pressurized gas. However, manual tank replacement can be particularly inconvenient. For example, replacing an empty tank of carbon dioxide during lunch at a restaurant may be particularly inconvenient since no personnel may be available to effect the replacement. However, consumers generally prefer beverages carbonated and sales generally drop when carbonated beverages are not available in a particular dining establishment.

To address this problem, valves which automatically detect a reduction in pressure in a first tank and automatically switch to a second tank in response thereto have been developed. U.S. Pat. No. 5,014,733 to Wilson dated May 14, 1991 describes one such valve. The valve of the '733 patent uses mechanical devices to sense a drop in pressure and switches from a first supply tank to a second, full supply tank in response to the pressure drop.

To automatically trip the switching valve, the relatively high pressures of pre-regulated pressurized gas are required. Therefore, the switching value of the '733 patent is typically placed between the supply tanks and a regulator. Such generally has two primary drawbacks. The first is that the valve switches to the second supply tank when the first supply tank is not quite empty. Supply tanks generally store gas whose pressure can be as high as 850 psi and is regulated to about 100 psi for use in end-user equipment, e.g., carbonated beverage dispenser. Because of impression in mechanical switching mechanisms, conventional valves are adjusted to switch from the first supply tank to the second supply tank when the pressure of the gas in the first supply tank drops to about 200 psi. If such conventional valves were configured to switch at a lower pressure, the valve might not switch even if the pressure of the gas in the first supply tank dropped below 80 psi at which end-user equipment might become inoperative. However, even at 200 psi, gas in liquid form is still present in the first supply tank. Such premature discontinuation of use of the first supply tank costs the customer of the pressurized gas since a substantial amount of the gas is never used.

The second drawback of switching unregulated gas is that such conventional switching valves cannot be used with newer, bulk pressurized gas tanks which hold a much larger quantity of pressurized gas at a lower pressure, i.e., typically about 230 psi. Since such conventional valves are configured to switch from the first supply tank to the second supply tank when the pressure of the first tank drops below about 200 psi, such a conventional valve would switch before much of the pressurized gas in the bulk system is used. Such bulk systems require a much more precise switching mechanism.

Conventional switching valves such as that described in the '733 patent suffer from further disadvantages. For example, conventional valves only switch from the first supply tank to the second supply tank. When the pressure in the second supply tank drops below the threshold pressure, the valve must generally be manually reset to again supply pressurized gas from the first supply tank to the end-user equipment. By this time, the first supply tank which was previously empty hopefully has been replaced with a new first supply tank which is full. However, the user is not informed that the second supply tank is nearly empty and the end-user equipment must generally become inoperative before the user knows to replace the second supply tank. Unfortunately, it is also generally the first time the user is informed that the first supply tank is empty as well. Without careful observation by the user, the user is not informed that the valve has switched from the first supply tank to the second supply tank and, frequently, the first supply tank is not replaced until the second supply tank becomes empty. In this respect, such conventional automatically switching valves are no better than no switching valve at all except that the capacity of the first supply tank can be effectively doubled by adding the second supply tank.

SUMMARY OF THE INVENTION

In accordance with the present invention, an automatically switching valve measures pressure at an outlet line using an electric, pressure-sensitive switch which can be set to close at a predetermined pressure threshold within relatively narrow tolerances such that a pressure regulator can be placed between the pressurized gas supply tanks and the switching valve. As a result, the switching valve does not have to be constructed of heavy duty parts which might better withstand the extreme pressures of gas stored in unregulated tanks. In addition, the switching valve is suitable for use with newer, bulk pressurized gas systems which store gas at lower pressures since regulators are used to reduce the pressure of the gas in either high-pressure systems or low-pressure bulk systems to about the same range of pressures, e.g., about 100 psi.

One of a number of inlet lines is coupled to the outlet line by a solenoid such that pressurized gas is passed from a selected one of the inlet lines to the outlet lines, thereby selecting one of a number of pressured gas supplies, each of which is coupled to a respective one of the inlet lines. The particular inlet line selected by the solenoid is determined by the state of an impulse relay which is coupled between the solenoid and the pressure-sensitive switch. Closing of the pressure-sensitive switch in response to the drop in pressure below the predetermined threshold sends an electric signal to the relay. In response to the electric signal, the relay changes state to thereby cause a different inlet line to be selected, thus changing the particular pressurized gas supply from which the outlet line receives pressurized gas.

The use of a relay which has a respective state for each supply of pressurized gas and which changes states in response to drops in pressure sensed by the pressure-sensitive switch is that the system never needs to be manually reset. For example, if the switching valve has two inlet line and two respective pressurized gas sources, the relay has two respective states, each of which corresponds to a particular inlet line. When the relay is in the first state and gas is supplied through the first inlet line, an electric signal from the pressure-sensitive switch causes the relay to toggle to the second state. In the second state, gas is supplied through the second inlet line. A subsequent signal from the pressure-sensitive switch causes the relay to toggle back to the first state in which gas is again supplied through the first inlet line. Thus, when the first pressurized gas supply is empty, the switching valve automatically switches to the second pressurized gas supply and the first pressurized gas supply is replaced with a full supply. Then, when the second pressurized gas supply is empty, the switching valve automatically switches back to the first pressurized gas supply and the second pressurized gas supply is replaced with a full supply. No manual resetting of the switching valve according to the present invention is required.

The electric signal of the pressure-sensitive switch also triggers a remote signaling device to signal a remote location. For example, the electric signal can trigger dialing of a predetermined telephone number by an automatic dialer. When connected to the remote location, the dialer can transmit a predetermined message which uniquely identifies a particular pressurized gas dispensing installation as the installation in which an empty pressurized-gas supply is detected. In one embodiment, the electric signal is received by a second relay which applies power to the automatic dialer for a period of time which is significantly longer than the length of the electric signal, e.g., 2–3 seconds. Such an amount of time is sufficient in one embodiment to allow the automatic dialer to connect to the remote location and transmit the predetermined signal.

Since the remote location is signaled in response to the electric signal generated by the pressure-sensitive switch in response to a sensed drop in pressure below a predetermined threshold, the remote signal indicates that an empty pressurized gas supply has been detected. In one embodiment, the remote signal is received directly by a supplier of pressurized gas such that a new pressurized gas supply is received by the customer of the pressurized gas without any action taken by the customer. Therefore, monitoring the gas supply by the customer is entirely unnecessary. In addition, the likelihood that pressurized gas becomes unavailable at an installation using the switching valve with remote signaling is reduced greatly.

DETAILED DESCRIPTION

Figure 1:
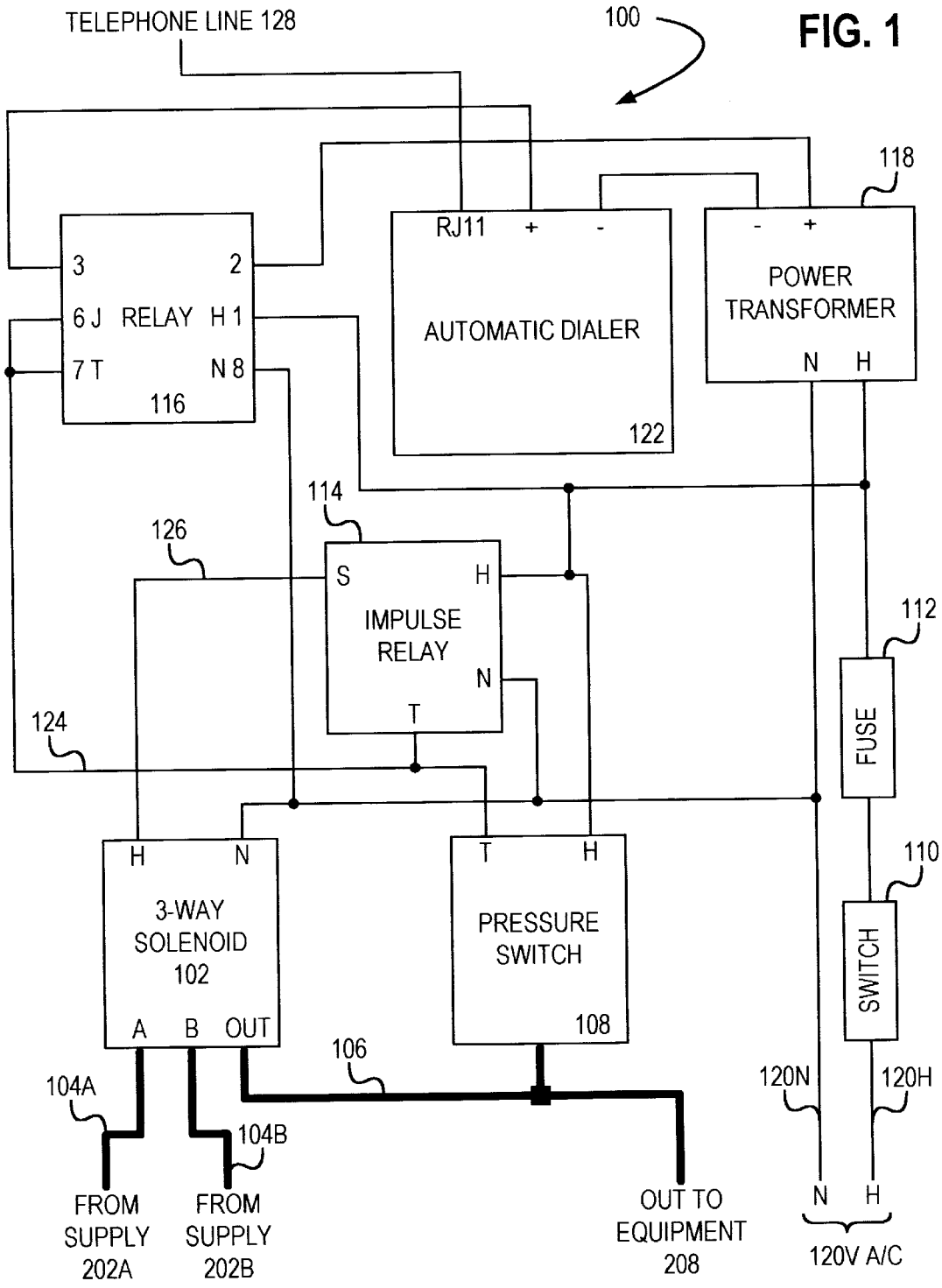
FIG. 1 is a block diagram of a switching valve according to the present invention.

In accordance with the present invention, a switching valve 100 (FIG. 1) senses a drop in pressure of pressurized gas supplied by one of two pressurized gas supplies 202A–B (FIG. 2) triggers an automatic switch to the other of supplies 202A–B and automatic transmission of a signal to a remote location to indicate that one of supplies 202A–B is empty. As used herein, remote signaling refers to signaling in such a way that obviates direct observation of gas supplies 202A–B and switching valve 100.

Figure 2:
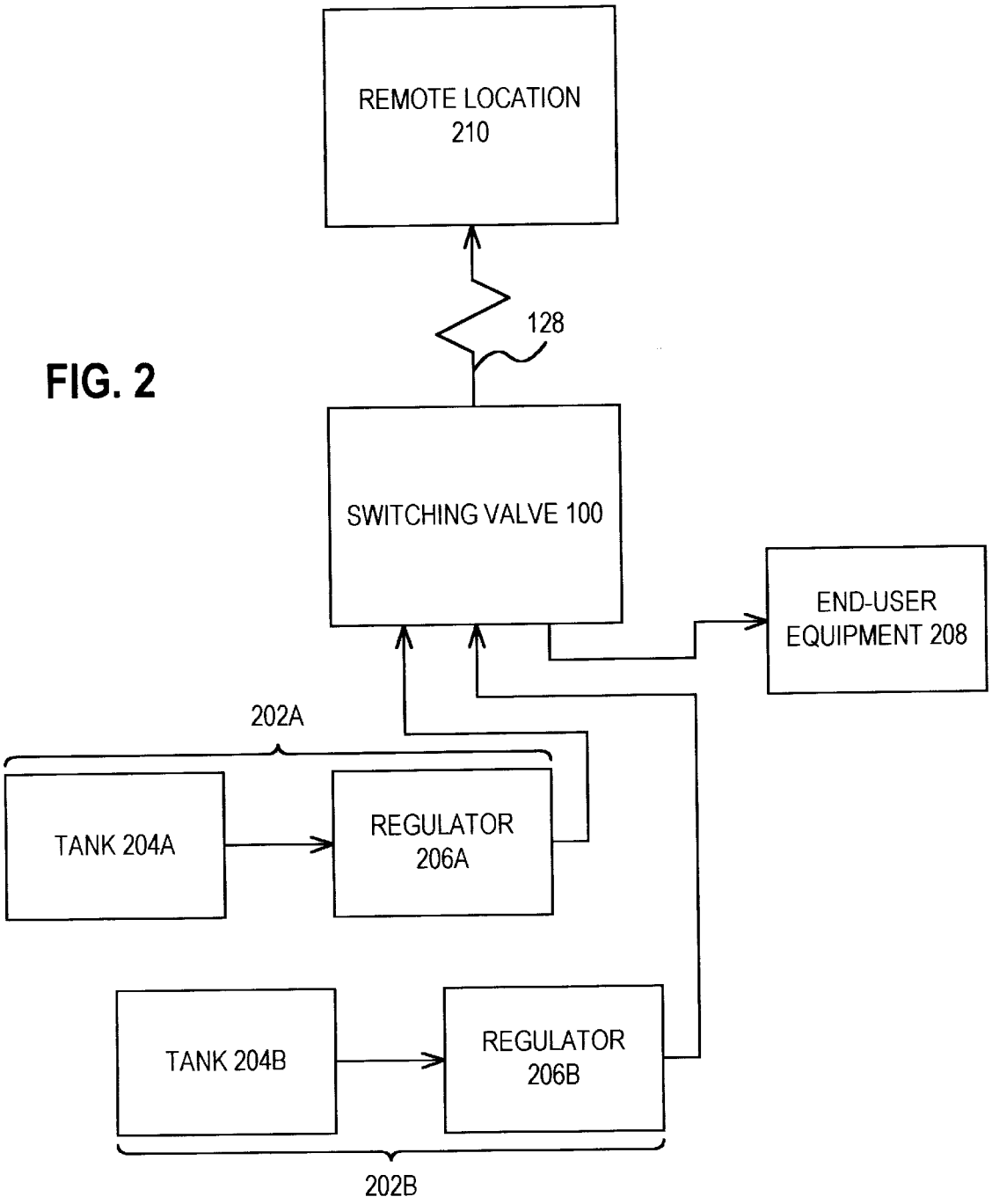
FIG. 2 is a block diagram of the switching valve of FIG. 1 connected between two regulated gas supplies and end-user equipment.

Switching valve 100 (FIG. 1) includes a 3-way solenoid 102 which passes pressurized gas from either of inlet lines 104A or 104B to an outlet line 106. In FIG. 2, inlet lines 104A and 104B are coupled to supplies 202A and 202B, respectively. Solenoid 102 (FIG. 1) and the manner in which solenoid 102 is controlled are described more completely below. An electric pressure-sensitive switch 108 is coupled to outlet line 106 and senses the pressure of the gas within outlet line 106. Since one of inlet lines 104A–B is coupled to outlet line 106 by solenoid 102, sensing the pressure of gas in outlet line 106 simultaneously senses the pressure of gas in the one of inlet lines 104A–B coupled to outlet line 106 and, therefore, in the respective one of supplies 202A–B (FIG. 2). Switch 108 (FIG. 1) is, in one embodiment, a class 9012 pressure switch available from Square D of Raleigh, N.C. which has a user-selectable switching threshold which in turn can be adjusted within a range of zero to 125 psi. Since switch 108 is electronic, switch 108 can be calibrated to close when pressure in outlet line 106 drops below a switching threshold within relatively low tolerance, e.g., within about plus or minus five (5) psi. In one embodiment, the switching threshold is set to about 90 psi. In pressurized gas supply tanks used in carbonated beverage dispensers, the gas is supplied from a regulator at about 100 psi and drops to 90 psi only when the gas in liquid form is completely absent from the supply tank. However, end-user equipment is usually completely operational when gas is supplied at a pressure of 90 psi. In addition, since the switching threshold is about 90 psi, the pressurized gas received through inlet lines 104A and 104B is typically regulated. For example, pressurized gas supply 202A (FIG. 2) includes a pressurized tank 204A and a regulator 206A. Pressure tank 204A can hold pressurized gas at pressures in excess of 800 psi; however, regulator 206A reduces the pressure to 100 psi such that switching valve 100 receives gas at a regulated pressure of about 100 psi. Pressurized gas supply 202B similarly includes a regulator 206B which regulates the pressurized gas passed to switching valve 100 to about 100 psi. Accordingly, pressurized tank 204B of pressurized gas supply can be either a high-pressure tank analogous to pressurized tank 204A or a bulk pressurized gas tank which stores large quantities of pressurized gas stored at about 230 psi. Switching valve 100 operates in the same manner regardless of the type of pressurized tank used since switching valve 100 receives regulated pressurized gas.

Switching valve 100 (FIG. 1) is powered by an alternating current 120V electrical power source such as a standard wall outlet (not shown) to which switch valve 100 is coupled through a hot wire 120H and a neutral wire 120N. Switching valve 100 includes a switch 110 and a fuse 112 along hot wire 120H. Switch 110 allows a user to switch the entirety of switching valve 100 off, and fuse 112 cuts off power to switching valve 100 in the event that one or more of the components of switching valve 100 is faulty. In one embodiment, fuse 112 is a one-amp fuse. Through switch 110 and fuse 112, hot wire 120H is coupled directly to switch 108, an impulse relay 114, a relay 116, and a power transformer 118. Neutral wire 120N is coupled directly to solenoid 102, impulse relay 114, relay 116, and power transformer 118.

Impulse relay 114 receives power through hot wire 120H and neutral wire 120N. Impulse relay 114 includes a toggle terminal (designated by "T") which is coupled to pressure switch 108 by a wire 124. In addition, impulse relay includes a select terminal (designated by "S") which is coupled to solenoid 102 by a wire 126. As described above, when gas pressure in outlet line 106 drops below the switching threshold, pressure switch 108 closes and hot line 120H is electrically coupled to wire 124 and therethrough to the toggle terminal of impulse relay 114, i.e., the toggle terminal of impulse relay 114 becomes "hot". In response, impulse relay 114 toggles between a first state in which the select terminal of impulse relay is electrically coupled to hot wire 120H through impulse relay 114 and a second state in which the select terminal of impulse relay is electrically insulated from hot wire 120H. In one embodiment, impulse relay 114 is the RLY7645 impulse relay available from Philips ECG of the North American Philips Company.

In the first state of impulse relay 114, wire 126 becomes hot and, in conjunction with neutral wire 120N, supplies power to solenoid 102. When solenoid 102 is powered, inlet line 104A is in communication with outlet line 106 and pressurized gas is passed from pressurized gas supply 202A (FIG. 2) through inlet line 104A (FIG. 1) to outlet line 106. Since end-user equipment 208 (FIG. 2) generally required pressurized gas to operate, it is preferred that solenoid 102 (FIG. 1) pass sufficient gas from either of inlet lines 104A through outlet line 106 to end-user equipment 208 to operate end-user equipment 208. In general, sufficient throughput of solenoid 102 is attained when solenoid 102 has a main orifice (not shown) which is at least as large as the larger of the orifices of regulators 206A–B (FIG. 2). In one embodiment, solenoid is the Type 330–331, Class H continuous duty, 3-way solenoid available from Burkert of Orange, Calif. and has an orifice which is one-eighth of an inch in diameter.

When the pressure of the gas within pressurized gas supply 202A drops below the switching threshold as measured by pressure switch 108 from outlet line 106, pressure switch 108 closes and the toggle terminal of impulse relay 114 becomes hot. In response, impulse relay 114 toggles to the second state.

In the second state of impulse relay 114, wire 126 is not hot and no power is supplied to solenoid 102. When solenoid 102 is not powered, inlet line 104B is in communication with outlet line 106 and pressurized gas is passed from pressurized gas supply 202B (FIG. 2) through inlet line 104B (FIG. 1) to outlet line 106. When solenoid 102 switches from inlet line 104A to inlet line 104B, gas pressure of pressurized gas supply 202B (i) is greater than the switching threshold since the second pressurized gas supply is new and full and (ii) is measured at outlet line 106 by pressure switch 108. Accordingly, pressure switch 108 opens and wire 124 is no longer hot. In general, switching of impulse relay 114 and solenoid 102 is very quick and wire 124 is hot for only a relatively short period of time, i.e., on the order of about one-quarter of a second. When the pressure of the gas within pressurized gas supply 202B (FIG. 2) drops below the switching threshold as measured by pressure switch 108 (FIG. 1) from outlet line 106, pressure switch 108 closes and the toggle terminal of impulse relay 114 becomes hot. In response, impulse relay 114 toggles back to the first state. When solenoid 102 switches from inlet line 104B back to inlet line 104A, gas pressure of pressurized gas supply 202A (FIG. 2) (i) is greater than the switching threshold since pressurized gas supply 202A is new and full and (ii) is measured at outlet line 106 (FIG. 1) by pressure switch 108. As described in greater detail below, pressurized gas supply 202A is new and full because switching valve 100 remotely signals a supplier of pressurized gas that a replacement supply is needed each time impulse relay 114 toggles between the first and second states.

Thus, switching valve 100 automatically switches from a first pressurized gas supply to a second when the first supply runs out and automatically switches from the second pressurized gas supply back to the first when the second supply runs out. No manual resetting is required. In addition, since pressure switch 108 is calibrated to close when pressure drops below the switching threshold within a relatively low tolerance, regulated pressurized gas can be applied to inlet lines 104A and 104B. As a result, solenoid 102, pressure switch 108, inlet lines 104A–B, and outlet line 106 do not have to handle extreme pressures which can be present in unregulated pressurized gas supplies, e.g., 800 psi or more. As a result, less expensive components can be used to manufacture switching valve 100.

As described briefly above, switching valve 100 remotely signals a supplier of pressurized gas that a replacement supply is needed each time impulse relay 114 toggles between the first and second states. Such remote signaling can include, for example, visual and/or audio signals presented in a place other than directly on pressurized gas supplies 202A–B (FIG. 2) or switching valve 100 such that direct inspection of pressurized gas supplies 202A–B or switching valve 100 is unnecessary. In one embodiment, switching valve 100 includes an automatic dialer 122 which is coupled through an RJ-11 or similar standard telephone jack to a telephone line 128. Automatic dialer 122 is configured to remotely signal a supplier of pressurized gas when powered. Automatic dialer 122 can signal the supplier in any of a number of ways. For example, automatic dialer 122 can dial a predetermined number and leave a prerecorded voice message which identifies the particular installation which requires a new pressurized gas supply. Alternatively, automatic dialer 122 can include a modem (not shown) and can be configured to connect to a remote computer through the modem and communicate directly to the computer the installation which requires a new pressurized gas supply. In one embodiment, automatic dialer 122 is the automatic dialer (stock no. 4943) available from Radio Shack, a division of Tandy Corporation of Fort Worth, Tex. The remote computer can then add information such as the current date and time and automatically schedule delivery of a new pressurized gas supply to the user of switching valve 100. In many cases, the user will be unaware that (i) a pressurized gas supply has become empty, (ii) switching valve 100 has switched from the empty pressurized gas supply to a full pressurized gas supply, and (iii) a new pressurized gas supply to replace the empty one is on it's way. The user's business will go on uninterrupted.

Relay 116 activates automatic dialer 122 when wire 124 becomes hot. As described above, relay 116 is directly coupled to hot wire 120H and neutral wire 120N and receives primary power therethrough. Wire 124 is coupled to both terminals 6 and 7 of relay 116 which is, in one embodiment, the CNS timer relay available from Potter & Brumfield of Princeton, Ind. Relay 116 has terminals 2 and 3 which are coupled to a positive terminal of power transformer 118 and a positive terminal of automatic dialer 122, respectively. When terminals 6 and 7 become hot, through wire 124, relay 116 electrically couples terminals 2 and 3 for a period of time, e.g., about 2–3 seconds.

power transformer 118 is directly coupled to, and receives A/C power through, hot wire 120H and neutral wire 120N. Power transformer 118 produces direct current power from the A/C power of hot wire 120H and neutral wire 120N and applies the direct current power to positive and negative terminals of power transformer 118. The negative terminal of power transformer 118 is directly coupled to a negative terminal of automatic dialer 122. As described above, the positive terminal of power transformer 118 is coupled to a positive terminal of automatic dialer 122 through terminals 3 and 2 of relay 116. When relay 116 electrically couples terminals 2 and 3 for a period of time, power transformer 118 supplies direct current power to automatic dialer 122 for that period of time and automatic dialer 122 remotely signals a supplier of pressurized gas through telephone line 128.

Thus, each time wire 124 becomes hot, automatic dialer 122 remotely signals a supplier of pressurized gas through telephone line 128. As described above, wire 124 becomes hot each time pressure switch 108 detects that pressure in a pressurized gas supply has dropped below the switching threshold. Therefore, the same trigger for switching between pressurized gas supplies coupled to respective ones of inlet lines 104A and 104B, i.e., wire 124 becoming hot, also triggers remote signaling through automatic dialer 122. As a result, when a supply of pressurized gas becomes empty, switching valve 100 automatically switches to pass to end-user equipment pressurized gas from an alternate supply and, at about the same time, automatically remotely signals a supplier of pressurized gas to come and replace the empty supply. No active intervention by the user of the pressurized gas is required, and the user never experiences a shortage of pressurized gas. Switching valve 100 therefore represents a substantial improvement over prior art systems.

The above description is illustrative only and is not limiting. Accordingly, the present invention is defined solely by the claims which follow and their full range of equivalents.

What is claimed is:

1. An apparatus comprising:

at least two inlet lines for receiving a pressurized gas;

an outlet line;

a switching mechanism which is operatively coupled between the inlet lines and the outlet line and which can couple a selected one of the inlet lines to the outlet line such that pressurized gas passes through the selected inlet line to the outline;

a remote signaling mechanism which is configured to send a remote signal when triggered; and a pressure sensing mechanism which is operatively coupled to the switching mechanism and the remote signaling mechanism and which is configured to sense a drop in pressure in at least one of the selected inlet line and outlet line and which is further configured to cause the switching mechanism to couple an alternate one of the inlet lines to the outlet line and to trigger the remote signaling mechanism to send a remote signal in response to a sensed drop in pressure below a predetermined threshold;

wherein the remote signaling mechanism is an automatic dialer and is configured to dial a predetermined telephone number and transmit a predetermined signaling message to the predetermined telephone number when triggered; and further wherein the predetermined signaling message includes unique identification of an installation of pressurized gas.

2. An apparatus comprising:

at least two inlet lines for receiving a pressurized gas;

an outlet line;

a switching mechanism which is operatively coupled between the inlet lines and the outlet line and which can couple a selected one of the inlet lines to the outlet line such that pressurized gas passes through the selected inlet line to the outlet line;

a remote signaling mechanism which is configured to send a remote signal when triggered; and a pressure sensing mechanism which is operatively coupled to the switching mechanism and the remote signaling mechanism and which is configured to sense a drop in pressure in at least one of the selected inlet line and outlet line and which is further configured to cause the switching mechanism to couple an alternate one of the inlet lines to the outlet line and to trigger the remote signaling mechanism to send a remote signal in response to a sensed drop in pressure below a predetermined threshold;

wherein the remote signaling mechanism is an automatic dialer and is configured to dial a predetermined telephone number and transmit a predetermined signaling message to the predetermined telephone number when triggered; and further wherein the predetermined signaling message includes a recorded sound message.

3. An apparatus comprising:

at least two inlet lines for receiving a pressurized gas;

an outlet line;

a switching mechanism which is operatively coupled between the inlet lines and the outlet line and which can couple a selected one of the inlet lines to the outlet line such that pressurized gas passes through the selected inlet line to the outlet line;

a pressure sensing mechanism which is operatively coupled to the switching mechanism and a remote signaling mechanism and which is configured to sense a drop in pressure in at least one of the selected inlet line and outlet line and which is further configured to cause the switching mechanism to couple a first one of the inlet lines to the outlet line in response to a sensed drop in pressure and is further configured to cause the switching mechanism to couple a second one of the inlet lines to the outlet in response to a first sensed drop in pressure and is further configured to cause the switching mechanism to couple the first inlet line to the outlet in response to a subsequent sensed drop in pressure; and a relay which is operatively coupled between the switching mechanism and the pressure sensing mechanism and which has a respective state corresponding to each of the inlet lines and which causes the switching mechanism to couple to the outlet line the one of the inlet lines which corresponds to a current one of the states of the relay.

4. The apparatus of claim 3 wherein the relay changes from a first one of the states to a second one of the states in response to a trigger signal received from the pressure sensing mechanism when the pressure sensing mechanism senses a drop in pressure; and further wherein the relay changes back to the first state in response to a subsequent trigger signal received from the pressure sensing mechanism when the pressure sensing mechanism senses a subsequent drop in pressure.

5. The apparatus of claim 4 wherein the number of inlet lines is two and further wherein the relay toggles between first and second states in response to each trigger signal received from the pressure sensing mechanism when the pressure sensing mechanism senses each drop in pressure.

6. An apparatus comprising:

at least two inlet lines for receiving a pressurized gas from respective regulators;

an outlet line;

a switching mechanism which is operatively coupled between the inlet lines and the outlet line and which can couple a selected one of the inlet lines to the outlet line such that pressurized gas passes through the selected inlet line to the outlet line; and a pressure sensing mechanism which is operatively coupled to the switching mechanism and a remote signaling mechanism and which is configured to sense a drop in pressure in at least one of the selected inlet line and outlet line and which is further configured to cause the switching mechanism to couple a first one of the inlet lines to the outlet line in response to the sensed drop in pressure;

wherein the switching mechanism comprises:

a solenoid; and a relay which has a respective state for each of the inlet lines.

* * * * *